US010111291B2

(12) United States Patent
Matsui

(10) Patent No.: US 10,111,291 B2
(45) Date of Patent: Oct. 23, 2018

(54) LIGHTING CIRCUIT AND VEHICULAR LAMP

(71) Applicant: Koito Manufacturing Co., Ltd., Tokyo (JP)

(72) Inventor: Kotaro Matsui, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 15/918,493

(22) Filed: Mar. 12, 2018

(65) Prior Publication Data

US 2018/0279434 A1 Sep. 27, 2018

(51) Int. Cl.
*H05B 33/08* (2006.01)

(52) U.S. Cl.
CPC ..... *H05B 33/0842* (2013.01); *H05B 33/083* (2013.01); *H05B 33/089* (2013.01)

(58) Field of Classification Search
CPC ..... H05B 33/0815; H05B 33/0818; H05B 33/0842; H05B 33/083; H05B 33/089; Y02B 20/347; H02M 1/08; H02M 3/335
See application file for complete search history.

(56) References Cited

U.S. PATENT DOCUMENTS 6,845,315 B2 * 1/2005 Hashimoto ..... F02D 11/107 123/396
8,456,866 B2 * 6/2013 Funaba ..... H02M 1/08 363/17
8,716,947 B2 * 5/2014 Elder ..... H05B 33/0818 315/224
9,265,109 B2 * 2/2016 Muramatsu ..... H05B 33/0815

FOREIGN PATENT DOCUMENTS

JP 2016-082691 A 5/2016

* cited by examiner

*Primary Examiner* — Haissa Philogene
(74) *Attorney, Agent, or Firm* — Abelman, Frayne & Schwab

(57) ABSTRACT

A drive circuit supplies a drive current to a second light source. A dummy load circuit is connected to a control line to which a lighting control signal, which instructs the second light source 304 to be turned on and off, is input, and the dummy load circuit sinks a dummy load current $I_{DUMMYLOAD}$ which decreases as a temperature increases.

16 Claims, 5 Drawing Sheets

450

LIGHTING CIRCUIT AND VEHICULAR LAMP

CROSS-REFERENCE TO RELATED APPLICATIONS

This application is based on and claims priority from Japanese Patent Application No. 2017-054962, filed on Mar. 21, 2017 with the Japan Patent Office, the disclosure of which is incorporated herein in its entirety by reference.

TECHNICAL FIELD

The present disclosure relates to a lamp used for an automobile or the like.

BACKGROUND

In the related art, a halogen lamp or a high intensity discharge (HID) lamp has been mainly used as a vehicular lamp, particularly, a light source of a headlamp, but recently, a vehicular lamp using a semiconductor light source such as a light emitting diode (LED) and a semiconductor laser (LD) is being developed instead of the halogen lamp or the high intensity discharge (HID) lamp.

Multiple light sources, which are controlled to be individually turned on and off, are mounted in the vehicular lamp. For example, in some instances, a light source for a low beam and a light source for a high beam are mounted in the vehicular lamp. FIGS. 1A and 1B are circuit diagrams of the vehicular lamp that is provided with the multiple light sources studied by the present inventors. In the drawings, a first light source 302 corresponds to the low beam, and a second light source 304 corresponds to the high beam.

A lighting circuit 400R of a vehicular lamp 300R in FIG. 1A is provided with a first drive circuit 410 and a second drive circuit 412 which correspond to the first light source 302 and the second light source 304, respectively. The respective drive circuits 410 and 412 are configured with (i) a converter for outputting constant current, or (ii) a combination of a converter for outputting constant voltage and a constant current circuit.

Power source voltage $V_{LO}$ is input to an LO terminal through a mechanical relay RY1. When the mechanical relay RY1 is turned on and the power source voltage $V_{LO}$ is supplied to the LO terminal, the first drive circuit 410 supplies drive current (lamp current) $I_{LAMP1}$ to the first light source 302. Power source voltage $V_{HI}$ is input to an HI terminal via a mechanical relay RY2. When the mechanical relay RY2 is turned on and the power source voltage $V_{HI}$ is supplied to the HI terminal, the second drive circuit 412 supplies drive current $I_{LAMP2}$ to the second light source 304.

In a vehicular lamp 300S in FIG. 1B, the two light sources 302 and 304 are connected in series. A common drive circuit 414 supplies common drive current $I_{LAMP}$ to a series connection circuit of the light sources 302 and 304. A bypass switch 430 is provided in parallel with the second light source 304, and a switch driver 432 turns off the bypass switch 430 when high-level voltage is input to the HI terminal. In this case, the drive current $I_{LAMP}$ is supplied to the second light source 304 such that the second light source 304 is turned on. When the HI terminal is at a low level, the switch driver 432 turns on the bypass switch 430. In this case, the drive current $I_{LAMP}$ is applied to the bypass switch 430 and the second light source 304 is turned off.

While the combination of the high beam and the low beam has been described here, the same problem may occur even in respect to a combination of other light sources. See, for example, Japanese Patent Application Laid-Open No. 2016-082691.

SUMMARY

The lowest energizing current (the lowest guarantee current) is defined for a relay because an oxide film is formed on a surface of a contact in an OFF state, and there is concern that a conduction failure occurs because the contact is oxidized when a current higher than the lowest energizing current is not supplied in an ON state (an electric conduction state). In the vehicular lamp 300R in FIG. 1A, both of the relays RY1 and RY2 are provided on power source lines via which a somewhat high current flows, and as a result, it is ensured that the current higher than the lowest energizing current flows in the respective relays.

Meanwhile, in the vehicular lamp 300S in FIG. 1B, an impedance for an interior of a lighting circuit 400S as seen from the HI terminal is high. That is, the relay RY2 is not disposed on the power source line, but on a signal line. For this reason, there is concern that the current flowing in the relay RY2 is lower than the lowest energizing current when the relay RY2 is turned on for a period of time for which the high beam is turned on.

The present disclosure has been made in consideration of the aforementioned situations, and one of the exemplary objects of the aspect of the present disclosure is to provide a lighting circuit capable of inhibiting deterioration of a relay.

An aspect of the present disclosure relates to a lighting circuit that operates a light source. The lighting circuit includes: a drive circuit configured to supply a drive current to the light source; and a dummy load circuit connected to a control line into which a lighting control signal, which instructs the light source to be turned on and off, is input, and configured to sink a dummy load current which decreases as a temperature increases.

The lighting circuit may further include a bypass switch provided in parallel with the light source. The lighting control signal may be a signal that controls the bypass switch.

The lighting circuit may further include a constant current source provided in series with the light source. The lighting control signal may be a signal that controls the constant current source.

Another aspect of the present disclosure relates to a lighting circuit that operates a first light source and a second light source connected in series. The lighting circuit includes: a bypass switch provided in parallel with the second light source; a drive circuit configured to apply a drive current to a series connection circuit including the first light source and the second light source; and a dummy load circuit connected to a control line to which a lighting control signal, which instructs the second light source to be turned on and off, is input, and configured to sink a dummy load current which decreases as a temperature increases.

According to the aspect, it is ensured that a current higher than the dummy load current flows in an electric conduction state in an outer relay connected to the control line, and as a result, it is possible to inhibit deterioration of the contact of the relay. In addition, the dummy load circuit is considered as a heat source in the lighting circuit such that the lighting circuit itself is easily and thermally designed by decreasing the amount of generated heat by decreasing the dummy load current in a state in which a temperature is high, and as a result, the degree of freedom in terms of choosing components of configuration elements of the dummy load circuit is enhanced.

The dummy load circuit may include: a transistor and a resistor sequentially provided in series between the control line and the ground; and a bias circuit configured to apply a bias voltage to a control terminal of the transistor. The bias voltage is substantially constant within a first temperature range and decreases together with a temperature within a second temperature range higher than the first temperature range.

The bias circuit may include: a thermistor having a positive temperature characteristic and provided between the control line and the control terminal of the transistor, and a Zener diode provided between the control terminal of the transistor and the ground. According to the configuration, it is possible to maintain a constant dummy load current in a room temperature region and in a temperature region lower than the room temperature region, and it is possible to decrease the dummy load current in a temperature region higher than the room temperature region as a temperature increases.

The transistor may be a bipolar transistor, and the bias circuit may further include a diode which is provided in series with the Zener diode between the control terminal of the transistor and the ground. It is possible to cancel an influence by a temperature on the forward voltage of the diode and on the base-emitter voltage of the transistor, and as a result, it is possible to generate the dummy load current in proportion to Zener voltage in the room temperature region.

Another aspect of the present disclosure relates to a vehicular lamp. The vehicular lamp may include: a first light source and a second light source which are connected in series; and one of the aforementioned lighting circuits configured to operate the first light source and the second light source. The second light source may be a high beam.

Any combinations of the aforementioned constituent elements or substitutions of the constituent elements and expressions of the present disclosure between the method, the apparatus, the system, and the like are also effective as aspects of the present disclosure.

According to the aspect of the present disclosure, it is possible to inhibit deterioration of the relay.

The foregoing summary is illustrative only and is not intended to be in any way limiting. In addition to the illustrative aspects, embodiments, and features described above, further aspects, embodiments, and features will become apparent by reference to the drawings and the following detailed description.

DESCRIPTION OF EMBODIMENT

Figure 1A:
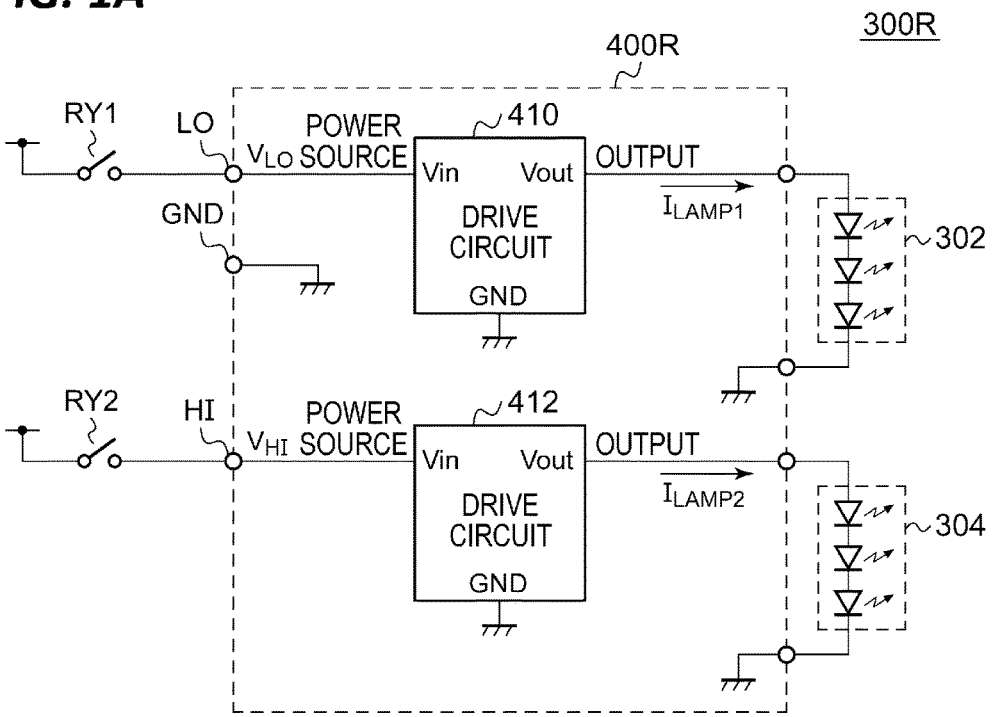
FIGS. 1A and 1B are circuit diagrams of the vehicular lamp provided with multiple light sources studied by the present inventors.
Figure 1B:
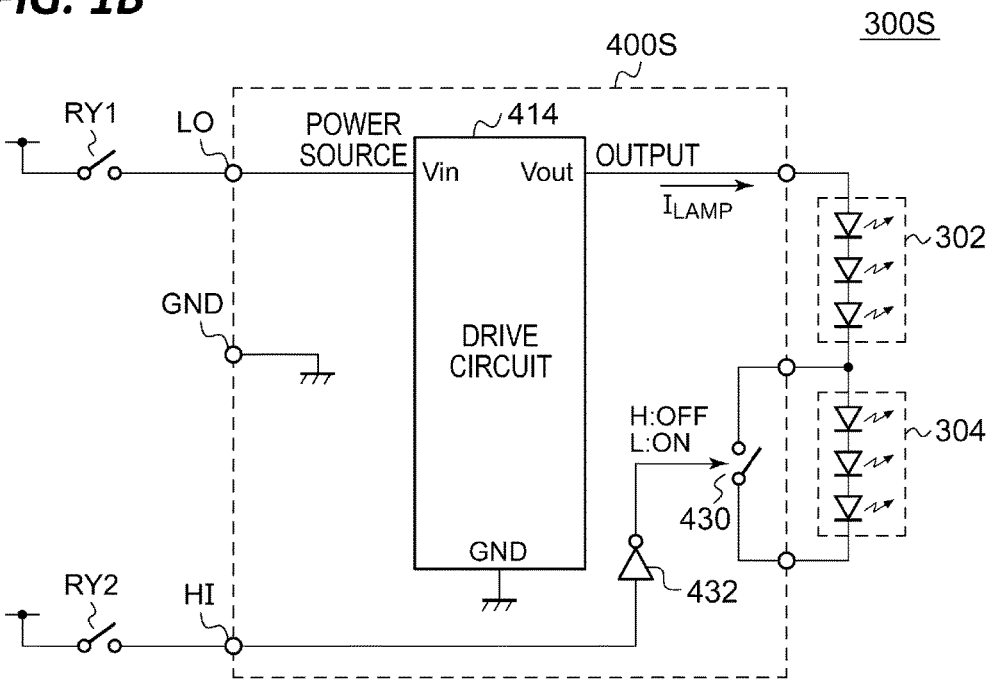

In the following detailed description, reference is made to the accompanying drawing, which form a part hereof. The illustrative embodiments described in the detailed description, drawing, and claims are not meant to be limiting. Other embodiments may be utilized, and other changes may be made without departing from the spirit or scope of the subject matter presented here.

Hereinafter, based on suitable exemplary embodiments, the present disclosure will be described with reference to the drawings. The same or equivalent constituent elements, members, processes illustrated in the respective drawings are denoted by the same reference numerals, and duplicated descriptions thereof will be appropriately omitted. In addition, the exemplary embodiment does not limit the invention, and all the features or combinations thereof, which are disclosed in the exemplary embodiment as an example, do not limit that the invention is necessarily essential.

In the present specification, "a state in which a member A and a member B are connected to each other" includes not only a case in which the member A and the member B are physically and directly connected to each other, but also a case in which the member A and the member B are indirectly connected to each other without substantially affecting an electrically connected state therebetween or causing damage to a function or an effect exhibited by the engagement therebetween, or through other members.

Similarly, "a state in which a member C is provided between a member A and a member B" includes not only a case in which the member A and the member C or the member B and the member C are directly connected to each other, but also a case in which the member A and the member C or the member B and the member C are indirectly connected to each other without substantially affecting an electrically connected state therebetween or causing damage to a function or an effect exhibited by the engagement therebetween, or through other members.

In the present specification, the symbols, which denote electrical signals such as voltage signals and current signals, or circuit elements such as resistors and capacitors, indicate, as necessary, voltage values, current values, resistance values, and capacitance values.

Figure 2:
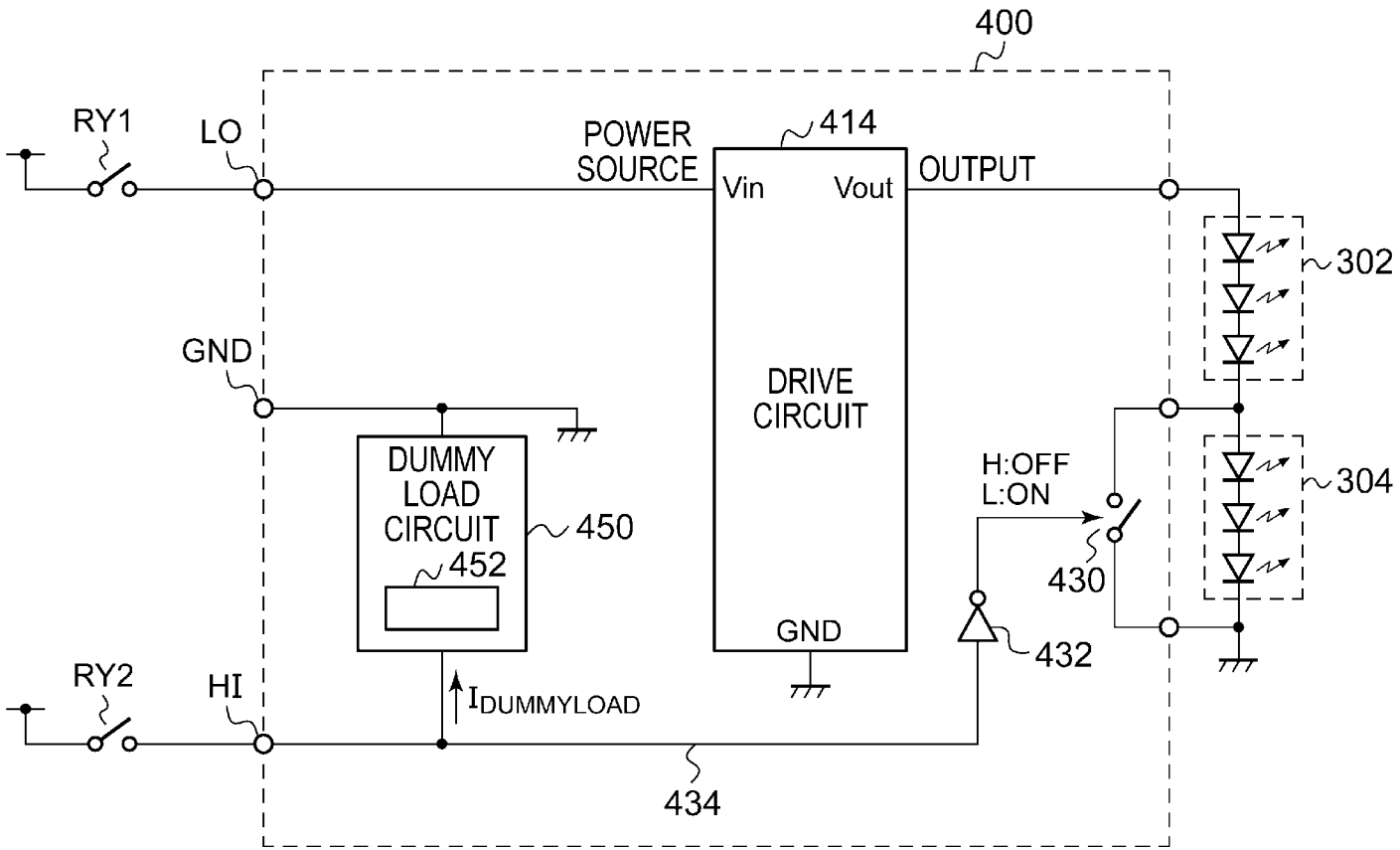
FIG. 2 is a block diagram of a vehicular lamp provided with a lighting circuit according to an exemplary embodiment.

FIG. 2 is a block diagram of a vehicular lamp 300 including a lighting circuit 400 according to an exemplary embodiment. The vehicular lamp 300 includes a first light source 302, a second light source 304, and a lighting circuit 400. The first light source 302 and the second light source 304 include a single or multiple LEDs connected in series, respectively. The first light source 302 and the second light source 304 are connected in series, and the lighting circuit 400 operates the first light source 302 and the second light source 304 connected in series.

In the present exemplary embodiment, the first light source 302 is, but not exclusively, a light source for a low beam, and the second light source 304 is, but not exclusively, a light source for a high beam. When a power source voltage $V_{LO}$ (e.g., the voltage $V_{BAT}$ of a non-illustrated battery) is supplied to an LO terminal, the lighting circuit 400 turns on the first light source 302. In addition, the lighting circuit 400 turns on the second light source 304 when a high-level voltage is input to an HI terminal, and the lighting circuit 400 turns off the second light source 304 when a low-level voltage is input to the HI terminal. A control signal, which instructs the first light source 302 to be turned on and off, may be input in addition to the supply of the power source voltage $V_{LO}$ to the LO terminal.

The power source voltage $V_{LO}$ is input to the LO terminal through a mechanical relay RY1. A lighting control signal $V_{HI}$, which instructs the second light source 304 to be turned on and off, is input to the HI terminal through a mechanical relay RY2. The lighting circuit 400 includes a drive circuit 414, a bypass switch 430, a switch driver 432, and a dummy load circuit 450. The bypass switch 430 is provided in parallel with the second light source 304. The drive circuit 414 supplies a drive current $I_{LAMP}$ to a series connection circuit including the first light source 302 and the second light source 304. The drive circuit 414 may be configured with a constant current converter. The switch driver 432 turns off the bypass switch 430 when the lighting control signal $V_{HI}$ is at a high level, and the switch driver 432 turns on the bypass switch 430 when the lighting control signal $V_{HI}$ is at a low level.

The dummy load circuit 450 is connected to a control line 434 to which the lighting control signal $V_{HI}$ is input, and the dummy load circuit 450 sinks a dummy load current $I_{DUMMYLOAD}$ from the control line 434. The dummy load circuit 450 is configured to decrease the dummy load current $I_{DUMMYLOAD}$ when a temperature is increased. Therefore, the dummy load circuit 450 may include a temperature detecting element 452.

Figure 3:
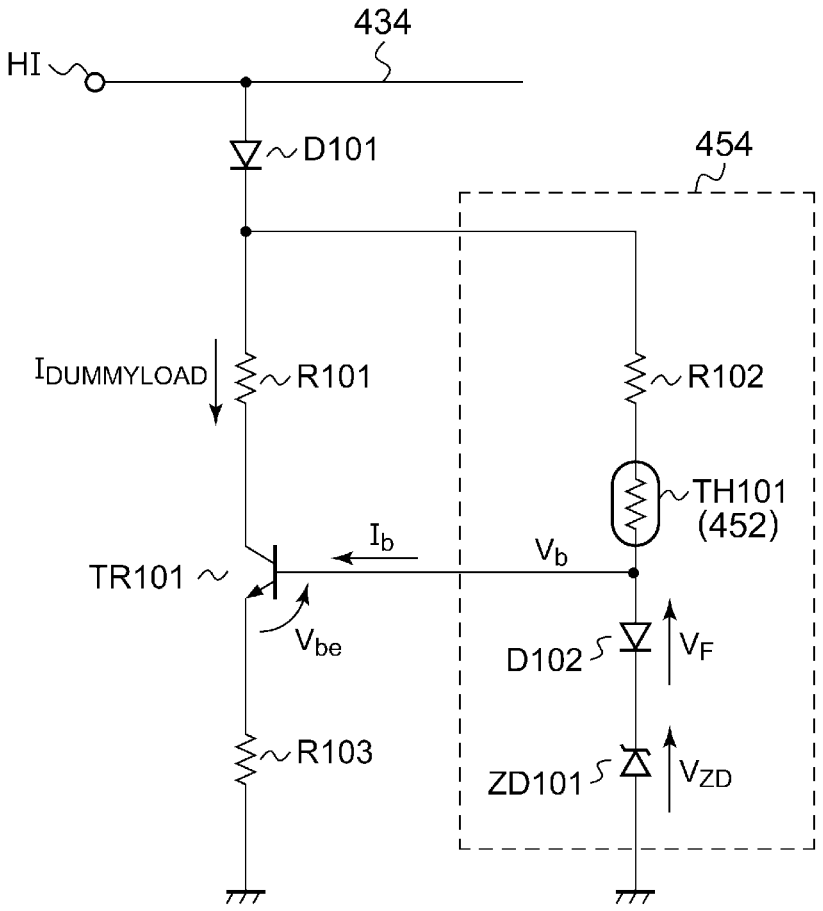
FIG. 3 is a circuit diagram of a dummy load circuit according to the exemplary embodiment.

FIG. 3 is a circuit diagram of the dummy load circuit 450 according to the exemplary embodiment. A transistor TR101 and a resistor R103 are sequentially provided in series between the control line 434 and the ground. A bias circuit 454 provides a control terminal of the transistor TR101 with a bias voltage $V_b$ which is substantially constant within a first temperature range and decreases together with the temperature within a second temperature range higher than the first temperature range. For example, the transistor TR101 is an NPN type bipolar transistor, and the emitter voltage thereof is $V_b-V_{be}$. $V_{be}$ is the base-emitter voltage of the transistor TR101. When the emitter voltage is applied to the resistor R103, the dummy load current $I_{DUMMYLOAD}$ indicated by Equation 1 flows in the series connection circuit of the transistor TR101 and the resistor R103.

$$I_{DUMMLOAD}=(V_b-V_{be})/R103 \quad (1)$$

An element having appropriate impedance is inserted between the control line 434 and a collector of the transistor TR101. In the present exemplary embodiment, a diode D101 and a resistor R101 are inserted, but the present disclosure is not limited thereto. The diode D101 prevents the dummy load current $I_{DUMMYLOAD}$ from flowing reversely.

The bias circuit 454 includes a thermistor TH101 which is the temperature detecting element 452. The thermistor TH101 is a positive thermal coefficient (PTC) thermistor, and a resistance value thereof indicates a constant resistance value in a room temperature region or in a temperature region lower than the room temperature region, and the resistance value is increased together with the temperature when the temperature exceeds a predetermined constant temperature. The thermistor TH101 is provided in series with a resistor R102 between the control line 434 and a control terminal (base) of the transistor TR101. The resistor R102 may be omitted in accordance with the resistance value of the thermistor TH101.

A Zener diode ZD101 is a constant voltage diode. A diode D102 and the Zener diode ZD101 are provided in series between the control terminal (base) of the transistor TR101 and the ground.

Figure 4:
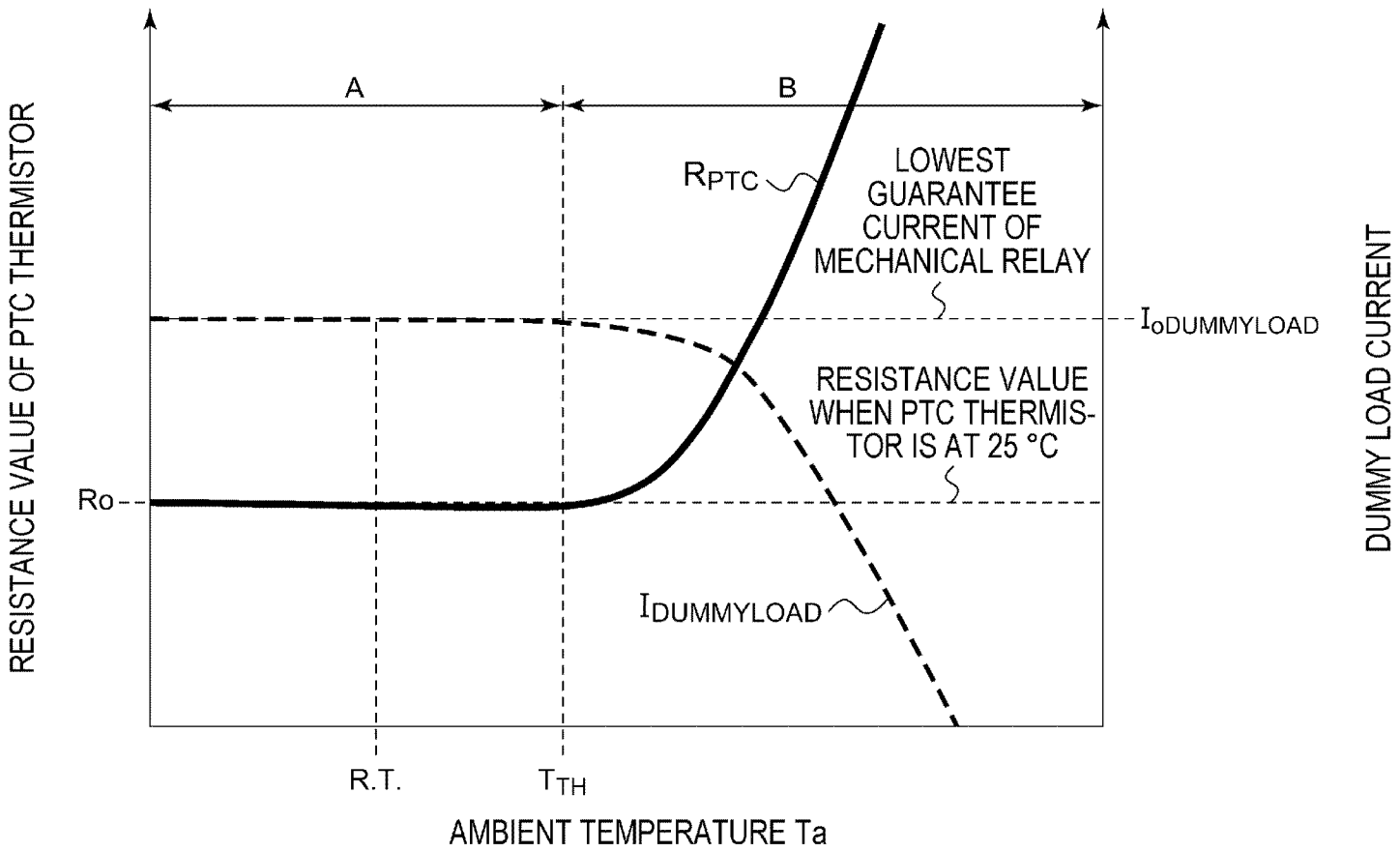
FIG. 4 is a view for explaining an operation of the dummy load circuit in FIG. 3.

The aforementioned configuration is a configuration of the vehicular lamp 300. An operation of the vehicular lamp 300 will be subsequently described. FIG. 4 is a view for explaining an operation of the dummy load circuit 450 in FIG. 3. R.T. indicates the room temperature. The bias voltage $V_b$ is indicated by Equation 2 within a first temperature range A in which an ambient temperature $T_a$ is lower than a predetermined constant value $T_{TH}$, and a resistance value of the thermistor TH101 is constant.

$$V_b=V_F+V_{ZD} \quad (2)$$

$V_F$ indicates the forward voltage of the diode D102, and $V_{ZD}$ indicates the Zener voltage of the Zener diode ZD101.

Equation 3 is obtained by substituting Expression 2 into Expression 1.

$$I_{DUMMLOAD}=(V_F+V_{ZD}-V_{be})/R103 \quad (3)$$

Expression 4 is obtained when $V_F \approx V_{be}$ is satisfied.

$$I_{DUMMLOAD}=V_{ZD}/R103 \quad (4)$$

That is, within the first temperature range, a constant dummy load current $I_{0DUMMLOAD}$, which does not depend on the ambient temperature $T_a$, may be generated. The constant dummy load current $I_{0DUMMLOAD}$ may be set to be equal to the lowest energizing current of the relay RY2.

Within a second temperature range B in which the ambient temperature $T_a$ is higher than the predetermined constant value $T_{TH}$, the resistance value $R_{PTC}$ of the thermistor TH101 is increased in accordance with an increase in temperature. By the resistance value $R_{PTC}$ of the thermistor TH101, the base current $I_b$ of the transistor TR101 is throttled, and the dummy load current $I_{DUMMYLOAD}$ is decreased.

The aforementioned operation is an operation of the vehicular lamp 300. Subsequently, an advantage of the vehicular lamp 300 will be described.

According to the lighting circuit 400 in FIG. 2, it is ensured that a current higher than the dummy load current $I_{DUMMYLOAD}$ flows in an electric conduction state in the outer relay RY2 connected to the control line 434. Therefore, it is possible to inhibit deterioration of a contact of the relay RY2 by setting the amount of the dummy load current $I_{DUMMYLOAD}$ to the amount equal to or higher than the lowest energizing current.

A further advantage of the lighting circuit 400 in FIG. 2 becomes clear by comparison with a comparative technology. In the comparative technology, a constant dummy load current, which does not depend on a temperature, is generated by a dummy load circuit. This comparative technology corresponds to a configuration in which the thermistor TH101 in FIG. 3 is omitted. The dummy load circuit acts as a heat source in the lighting circuit, and as a result, when the dummy load circuit further generates heat in a state in which the ambient temperature is high, the temperature of the lighting circuit is further increased. Therefore, it is necessary to improve heat dissipation properties of the lighting circuit, and constituent components of the dummy load circuit need to be chosen in consideration of an operation in a high temperature region. In general, the temperature of the lighting circuit 400 is increased by self-heating of the lighting circuit 400 which includes consumption of a dummy current as time is elapsed from the start of lighting.

In contrast, the dummy load circuit 450 of the present exemplary embodiment decreases the dummy load current $I_{DUMMYLOAD}$ in a high temperature state, and decreases the amount of generated heat. This acts in a direction in which a temperature of the lighting circuit 400 is decreased. Therefore, the lighting circuit 400 itself is easily and thermally designed, and the degree of freedom in terms of choosing constituent components of the dummy load circuit 450 is enhanced. Specifically, in a case in which the dummy load circuit 450 is configured as illustrated in FIG. 3, the sizes of the resistors R101 and R103 and the transistor TR101 may be decreased and inexpensive components may be chosen.

When the second light source 304 is turned on, the lighting circuit 400 comes into a high temperature state by self-heating caused by consumption of dummy current immediately after the second light source 304 is turned on, and when the second light source 304 is turned off in this state and then turned on immediately, a defect of the contact does not occur because an oxide film is not yet formed on the contact of the relay even though passing current of the mechanical relay RY2 at the time of turning on the second light source 304 again is lower than lowest passing current.

While the present disclosure has been described using specific words and phrases based on the exemplary embodiment, the exemplary embodiment just describes the principle and the application of the present disclosure, and many modified examples and changes in arrangement may be conceived from the exemplary embodiment without departing from the spirit of the present disclosure defined in claims.

Modified Example 1

Figure 5:
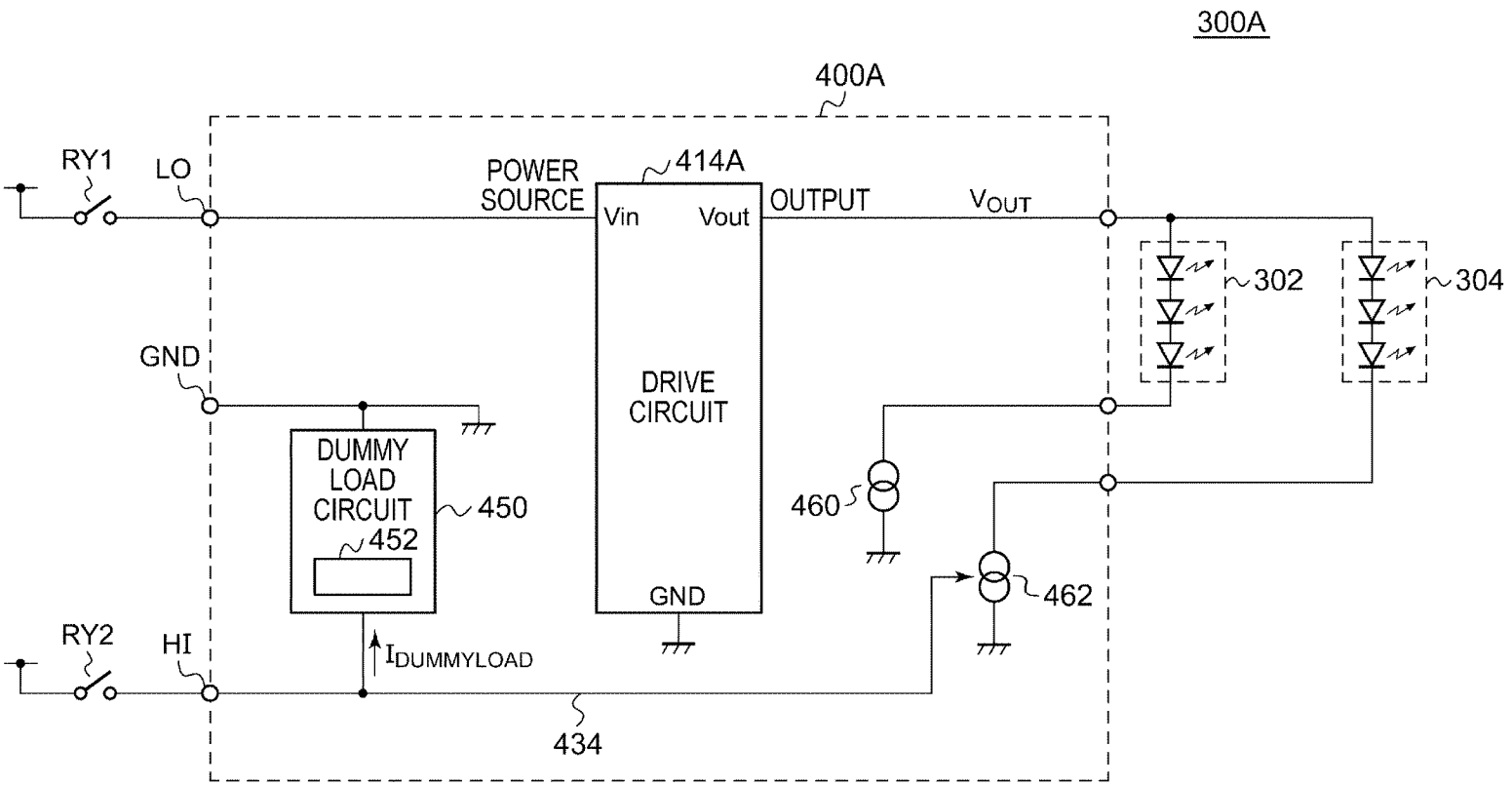
FIG. 5 is a block diagram of a vehicular lamp provided with a lighting circuit according to Modified Example 1.

FIG. 5 is a block diagram of a vehicular lamp 300A that includes a lighting circuit 400A according to Modified Example 1. A first constant current source 460 and a first light source 302 are connected in series, and a second constant current source 462 and a second light source 304 are connected in series. A drive circuit 414A outputs a constant voltage, and supplies a common drive voltage $V_{out}$ to the first light source 302 and the second light source 304 provided in parallel two paths. A control line 434 is connected to the second constant current source 462, and the second constant current source 462 is controlled to be turned on and off by a lighting control signal $V_{HI}$. Even in this modified example, it is possible to obtain an effect similar to the effect of the exemplary embodiment.

Modified Example 2

A field effect transistor (FET) may be used instead of the bipolar transistor as the transistor TR101, and in this case, the base may be read as a gate, the emitter may be read as a source, and the collector may be read as a drain. Further, in this case, the diode D102 may be omitted, and instead, the FET, which connects the gate and the drain, may be inserted. Therefore, it is possible to cancel an influence by a temperature on the gate-source voltage of the transistor TR101 of the FET.

Modified Example 3

The configuration of the dummy load circuit 450 is not limited to the configuration in FIG. 3. A person ordinarily skilled in the art may design a current source capable of creating the current $I_{DUMMYLOAD}$ having temperature dependency as illustrated in FIG. 4 using a PTC thermistor, an NTC thermistor, a thermocouple, and the like.

Modified Example 4

The light sources 302 and 304 are not limited to the LED, and an LD or an organic electro luminescence (EL) may be used. In addition, the drive circuit 414 is not limited to the switching converter, and the drive circuit 414 may be configured with a linear regulator or other circuits.

Modified Example 5

In the exemplary embodiment, the combination of the high beam and low beam has been described, but the present disclosure is not limited thereto, and may be applied to (i) a combination of a main low beam and an additional low beam, (ii) a combination of a clearance lamp and a fog lamp, and (iii) a combination of a turn lamp and daytime running lamps (DRL).

Modified Example 6

In the exemplary embodiment, the two light sources 302 and 304 are connected in series, but three or more light sources may be connected in series. In contrast, the multiple light sources are not essential, and the present technology may also be applied to a lighting circuit which operates a single light source. For example, a configuration in which the first light source 302 in FIG. 2 is omitted is allowable, and a configuration in which the first light source 302 and the first constant current source 460 in FIG. 5 are omitted is allowable.

That is, the present disclosure may be widely applied to a configuration in which the lighting control signal is input through the mechanical relay, and the mechanical relay is not disposed on a power line in which a high current flows, but disposed on a control line in which minute current (several mA or less) flows.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A lighting circuit that operates a light source, the lighting circuit comprising:

a drive circuit configured to supply a drive current to the light source; and a dummy load circuit connected to a control line into which a lighting control signal, which instructs the light source to be turned on and off, is input, and configured to sink a dummy load current which decreases as a temperature increases.

2. The lighting circuit of claim 1, further comprising:

a bypass switch provided in parallel with the light source, wherein the lighting control signal is a signal that controls the bypass switch.

3. The lighting circuit of claim 1, further comprising:

a constant current source provided in series with the light source, wherein the lighting control signal is a signal that controls the constant current source.

4. The lighting circuit of claim 1, wherein the dummy load circuit includes:

a transistor and a resistor sequentially provided in series between the control line and the ground; and a bias circuit configured to apply a bias voltage to a control terminal of the transistor, the bias voltage being substantially constant within a first temperature range and decreasing together with a temperature within a second temperature range higher than the first temperature range.

5. The lighting circuit of claim 2, wherein the dummy load circuit includes:

a transistor and a resistor sequentially provided in series between the control line and the ground; and a bias circuit configured to apply a bias voltage to a control terminal of the transistor, the bias voltage being substantially constant within a first temperature range and decreasing together with a temperature within a second temperature range higher than the first temperature range.

6. The lighting circuit of claim 3, wherein the dummy load circuit includes:

a transistor and a resistor sequentially provided in series between the control line and the ground; and a bias circuit configured to apply a bias voltage to a control terminal of the transistor, the bias voltage being substantially constant within a first temperature range and decreasing together with a temperature within a second temperature range higher than the first temperature range.

7. The lighting circuit of claim 4, wherein the bias circuit includes:

a thermistor having a positive temperature characteristic and provided between the control line and the control terminal of the transistor, and a Zener diode provided between the control terminal of the transistor and the ground.

8. The lighting circuit of claim 7, wherein the transistor is a bipolar transistor, and the bias circuit further includes a diode provided in series with the Zener diode between the control terminal of the transistor and the ground.

9. A vehicular lamp comprising:

a first light source and a second light source connected in series; and the lighting circuit of claim 1 configured to operate the first light source and the second light source.

10. A vehicular lamp comprising:

a first light source and a second light source connected in series; and the lighting circuit of claim 2 configured to operate the first light source and the second light source.

11. A vehicular lamp comprising:

a first light source and a second light source connected in series; and the lighting circuit of claim 3 configured to operate the first light source and the second light source.

12. A vehicular lamp comprising:

a first light source and a second light source connected in series; and the lighting circuit of claim 4 configured to operate the first light source and the second light source.

13. A vehicular lamp comprising:

a first light source and a second light source connected in series; and the lighting of claim 5 configured to operate the first light source and the second light source.

14. A vehicular lamp comprising:

a first light source and a second light source connected in series; and the lighting circuit of claim 6 configured to operate the first light source and the second light source.

15. A vehicular lamp comprising:

a first light source and a second light source connected in series; and the lighting circuit of claim 7 configured to operate the first light source and the second light source.

16. A vehicular lamp comprising:

a first light source and a second light source connected in series; and the lighting circuit of claim 8 configured to operate the first light source and the second light source.

* * * * *